US007253367B2

(12) United States Patent
Park et al.

(10) Patent No.: US 7,253,367 B2
(45) Date of Patent: Aug. 7, 2007

(54) INFORMATION INPUT SYSTEM FOR TERMINAL AND MULTIFUNCTIONAL BUTTON ASSEMBLY FOR USE IN THE SAME

(75) Inventors: Chan Hoon Park, Osan-si (KR); Min Young Song, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/656,459

(22) Filed: Jan. 23, 2007

(65) Prior Publication Data

US 2007/0114114 A1 May 24, 2007

Related U.S. Application Data

(62) Division of application No. 11/239,361, filed on Sep. 30, 2005, now Pat. No. 7,183,513.

(30) Foreign Application Priority Data

Nov. 2, 2004 (KR) ..... 2004-0088290
Jun. 7, 2005 (KR) ..... 2005-0048582

(51) Int. Cl.
*H01H 19/00* (2006.01)

(52) U.S. Cl. ..... 200/6 A; 200/5 R

(58) Field of Classification Search ..... 200/5 R, 200/5 A, 4, 14, 18, 6 A, 7, 336, 500; 273/118 R, 273/119 R, 138.1; 341/20–35; 345/160, 345/184, 168, 169
See application file for complete search history.

(56) References Cited

U.S. PATENT DOCUMENTS

| | | | | |
|---|---|---|---|---|
| 5,151,563 | A | 9/1992 | Tanaka | 200/6 A |
| 5,350,891 | A | 9/1994 | Ditzig | 200/6 A |
| 6,225,980 | B1 | 5/2001 | Weiss et al. | 345/161 |
| 6,359,243 | B1 | 3/2002 | Nakade et al. | 200/6 A |
| 6,570,105 | B1 | 5/2003 | Sallam et al. | 200/4 |
| 6,570,107 | B1 | 5/2003 | Nishimoto et al. | 200/6 R |
| 6,687,379 | B1 | 2/2004 | Thiel | 200/4 |
| 6,720,504 | B2 | 4/2004 | Nishimoto et al. | 200/4 |
| 6,867,379 | B2 * | 3/2005 | Hayashi | 200/4 |
| 2003/0230475 | A1 * | 12/2003 | Koide et al. | 200/564 |
| 2005/0284737 | A1 * | 12/2005 | Shitanaka et al. | 200/5 R |

FOREIGN PATENT DOCUMENTS

| | | |
|---|---|---|
| DE | 296 04 717 | 7/1996 |
| DE | 197 12 048 | 9/1998 |
| DE | 197 52 056 | 5/1999 |
| DE | 101 60 389 | 8/2002 |
| EP | 0 701 926 | 3/1996 |
| EP | 1 220 073 | 7/2002 |
| EP | 1 262 853 | 12/2002 |
| EP | 1 653 316 | 5/2006 |

* cited by examiner

*Primary Examiner*—Michael Friedhofer
*Assistant Examiner*—Lisa Klaus
(74) *Attorney, Agent, or Firm*—KED & Associates, LLP

(57) ABSTRACT

Embodiments of the invention provide an information input system for a terminal and a multifunctional button assembly for use in the information input system and methods for operating the same. The multifunctional button assembly can include a lever control button, a rotary button and a switch that can be mounted on a substrate. The multifunctional button assembly of the invention can provide advantages in that since the number of functions provided by the multifunctional button assembly is relatively increased, more functions can be concurrently employed, and a terminal employing the multifunctional button assembly can be manufactured to be light, thin, short and compact.

11 Claims, 9 Drawing Sheets

【Fig. 1】
Related Art
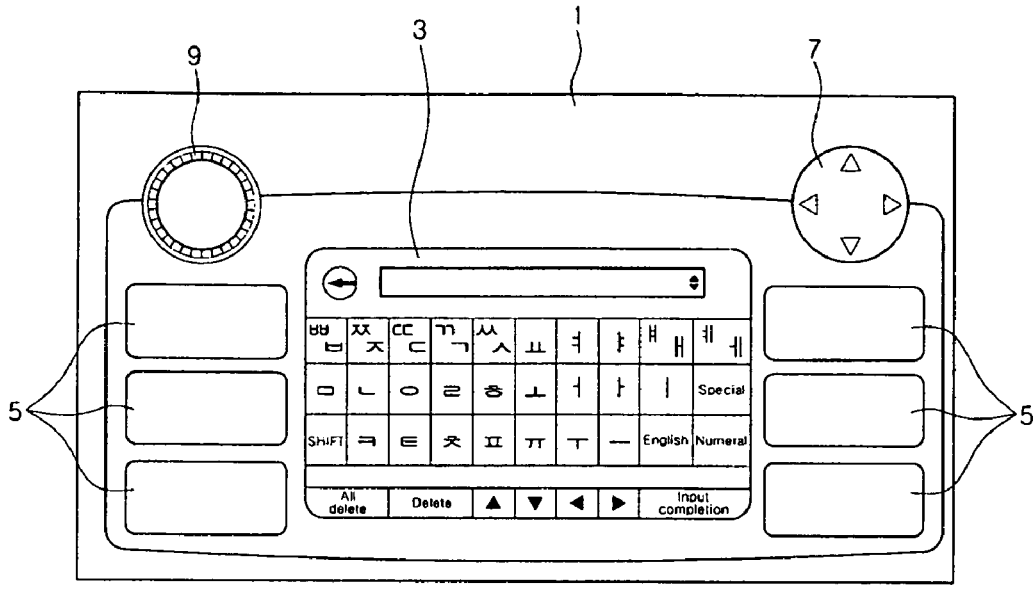

【Fig. 2】
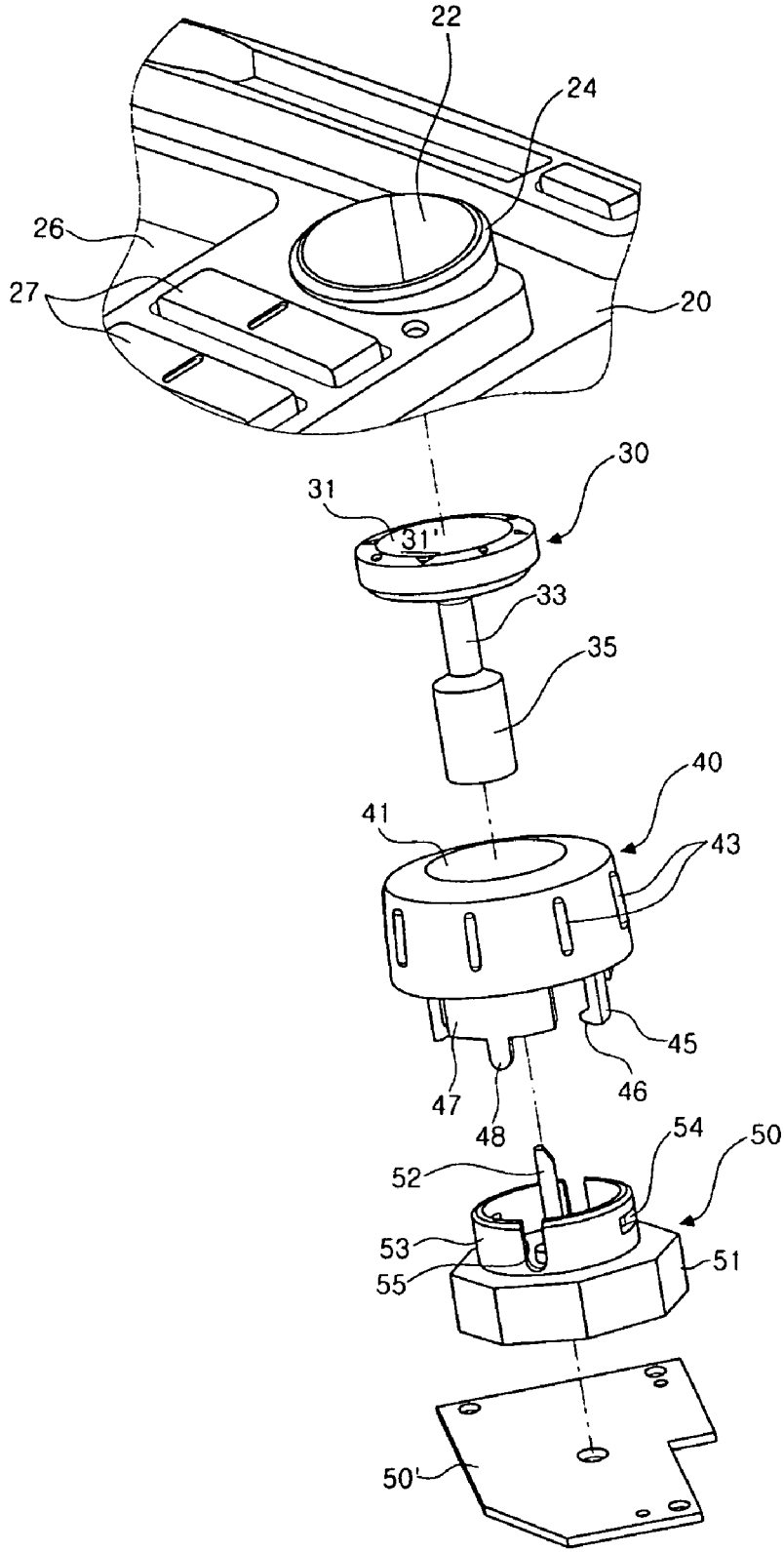

【Fig. 3】
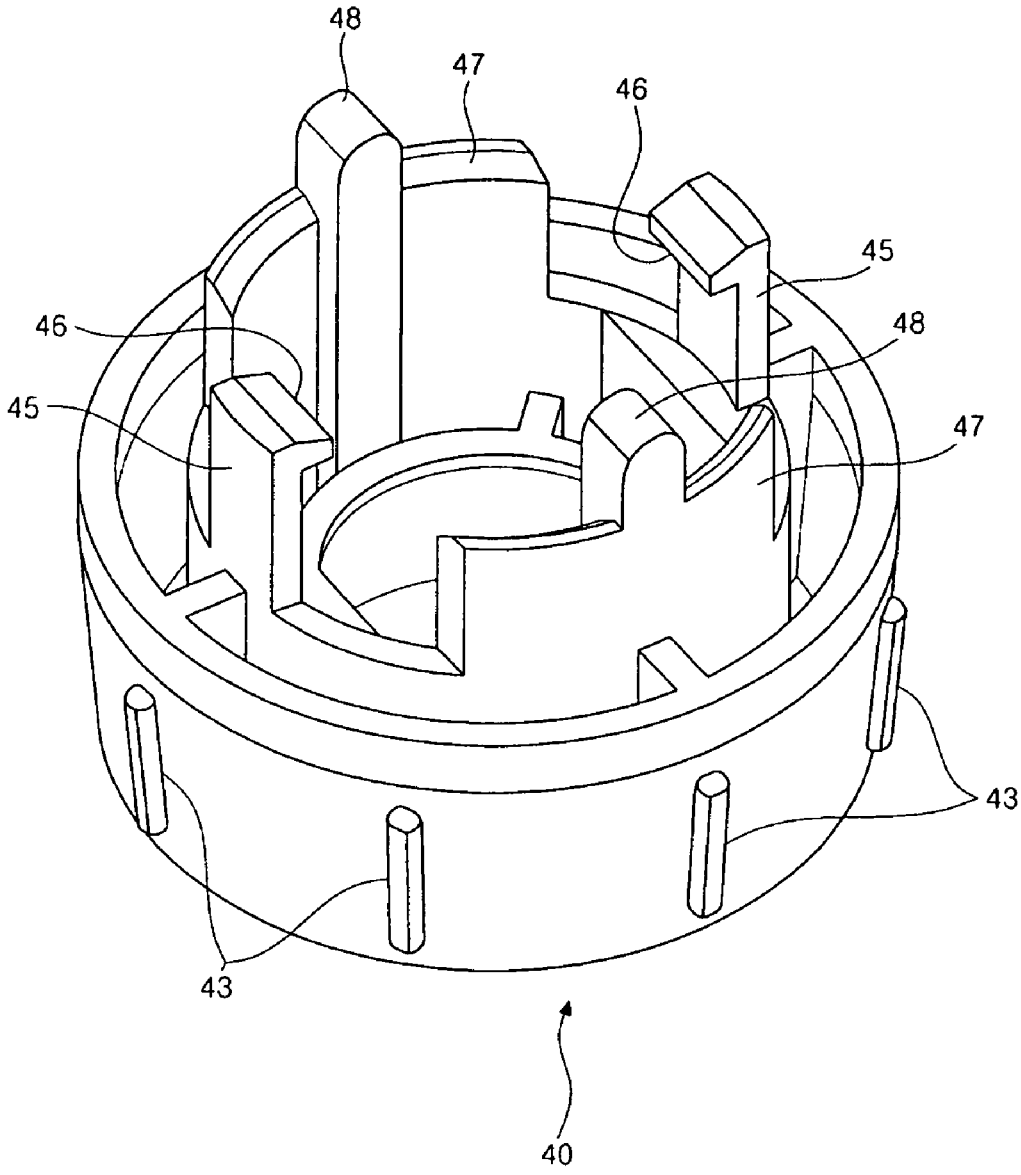

【Fig. 4】
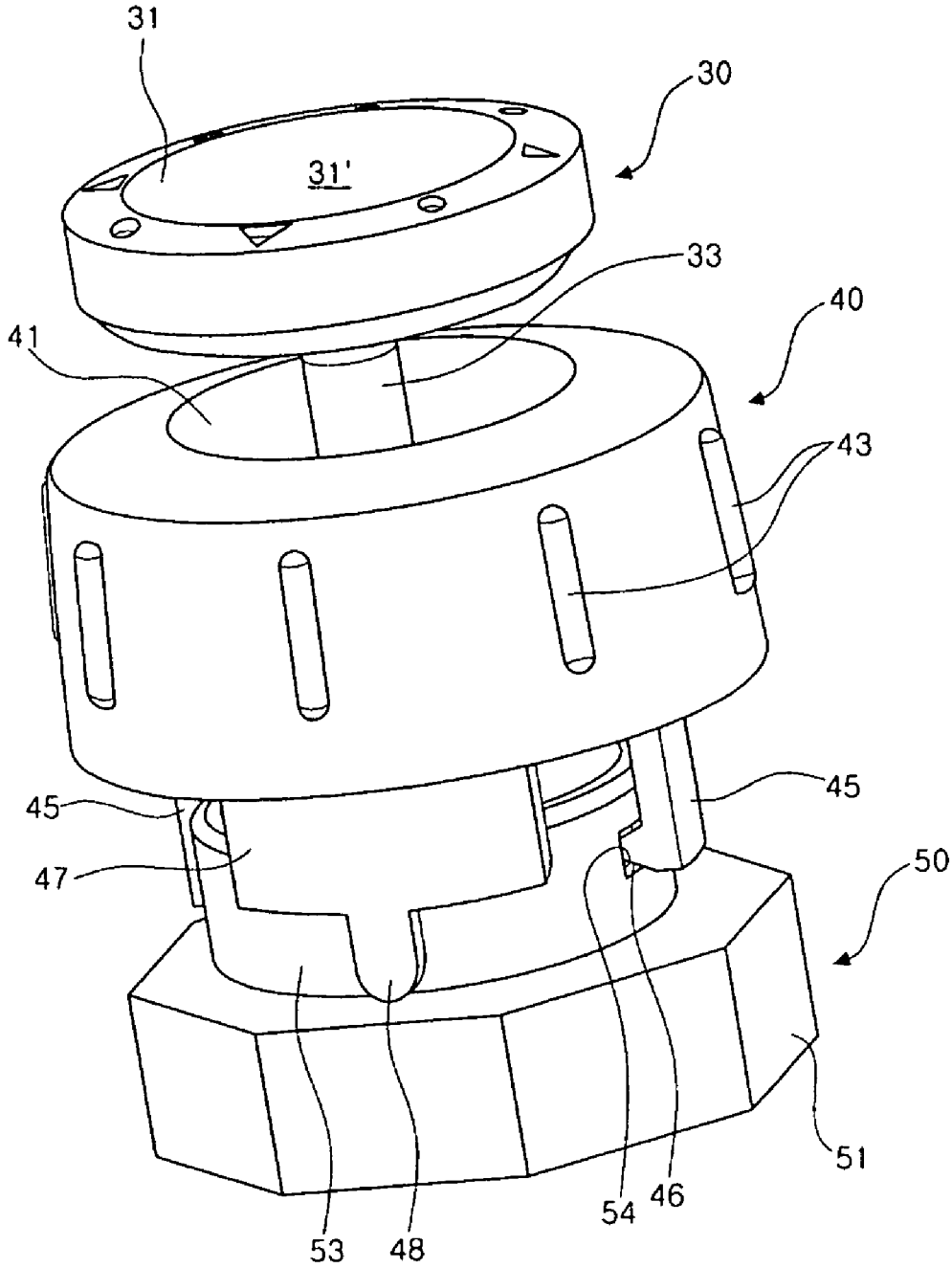

【Fig. 5a】
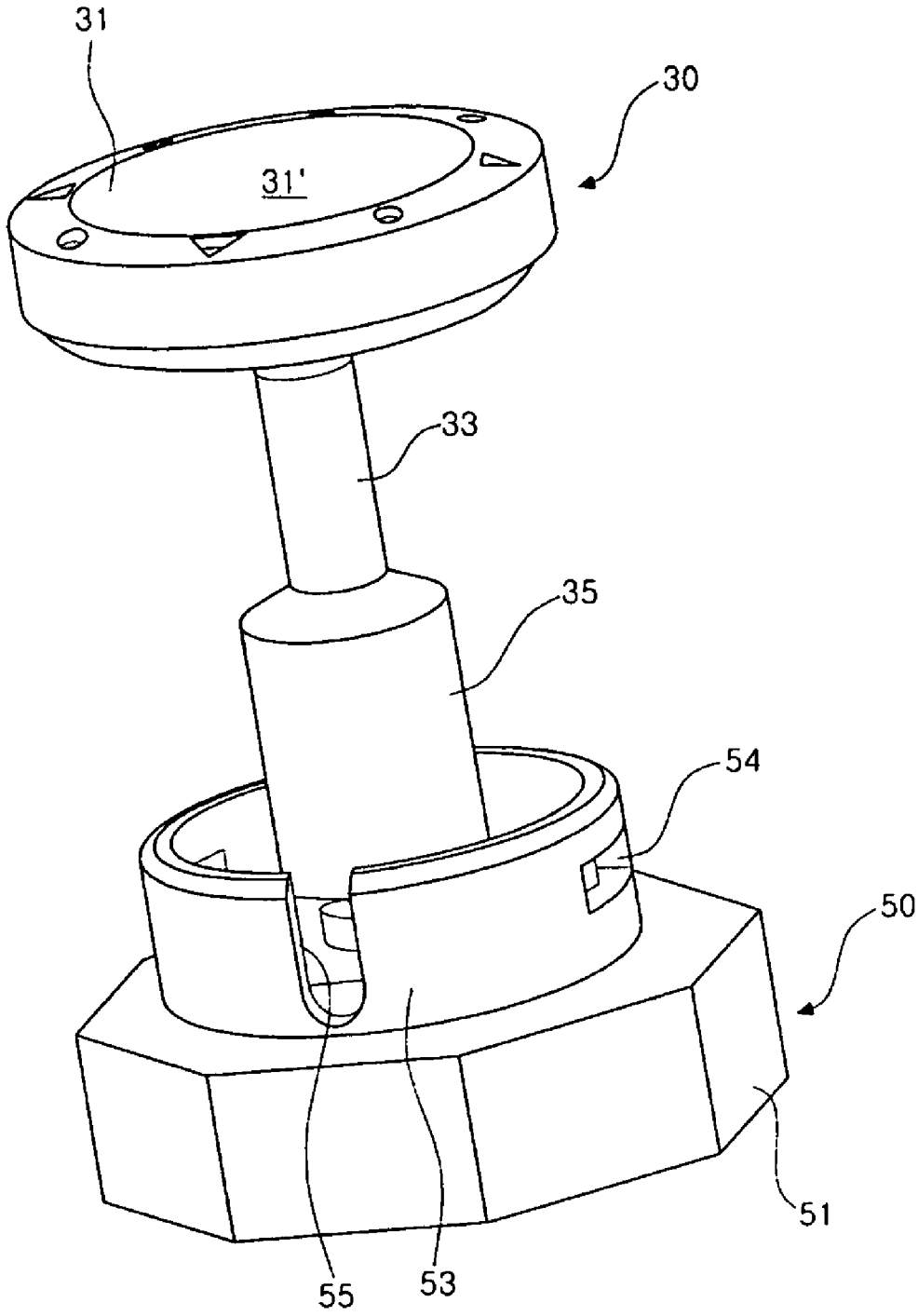

【Fig. 5b】
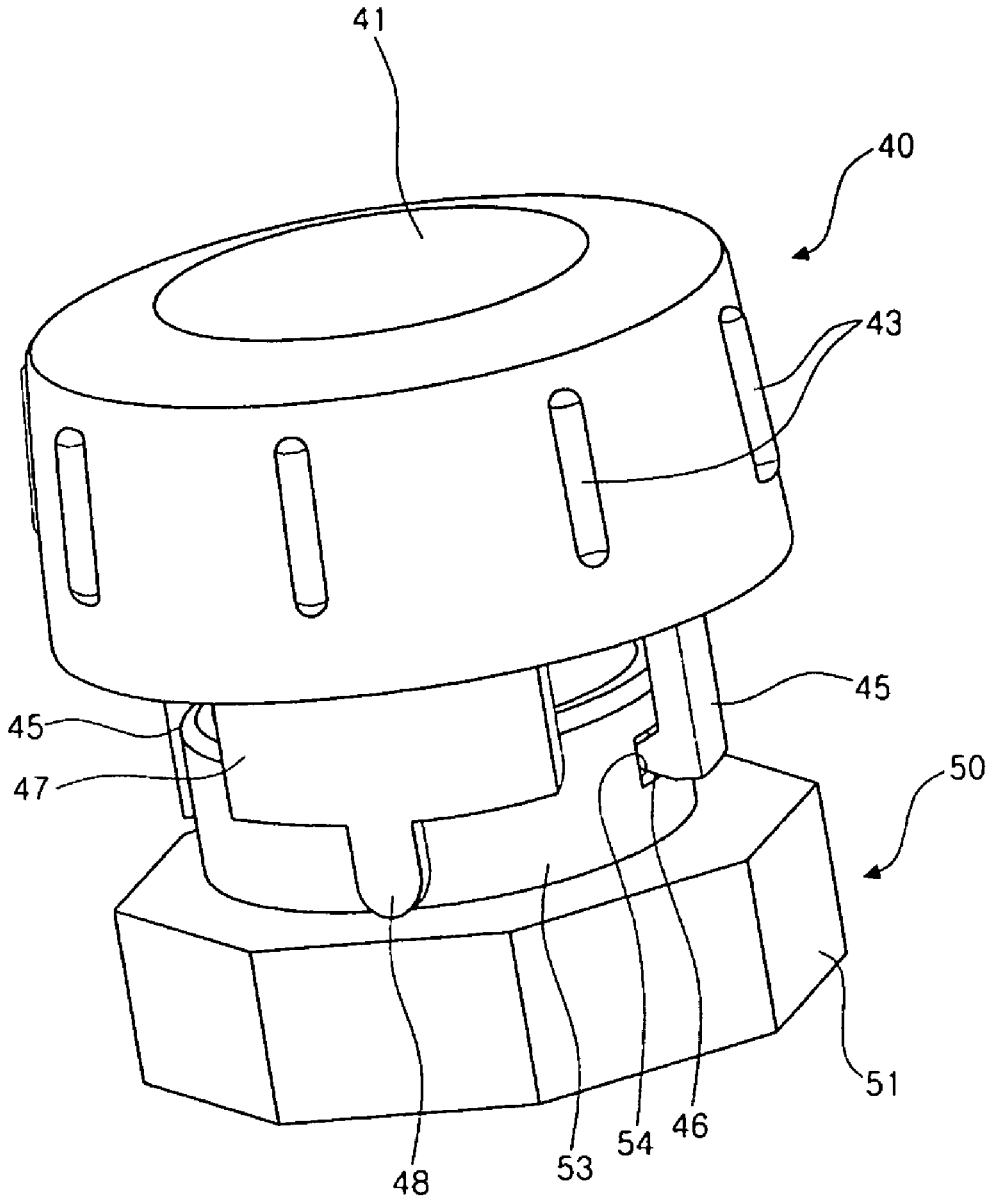

【Fig. 6】
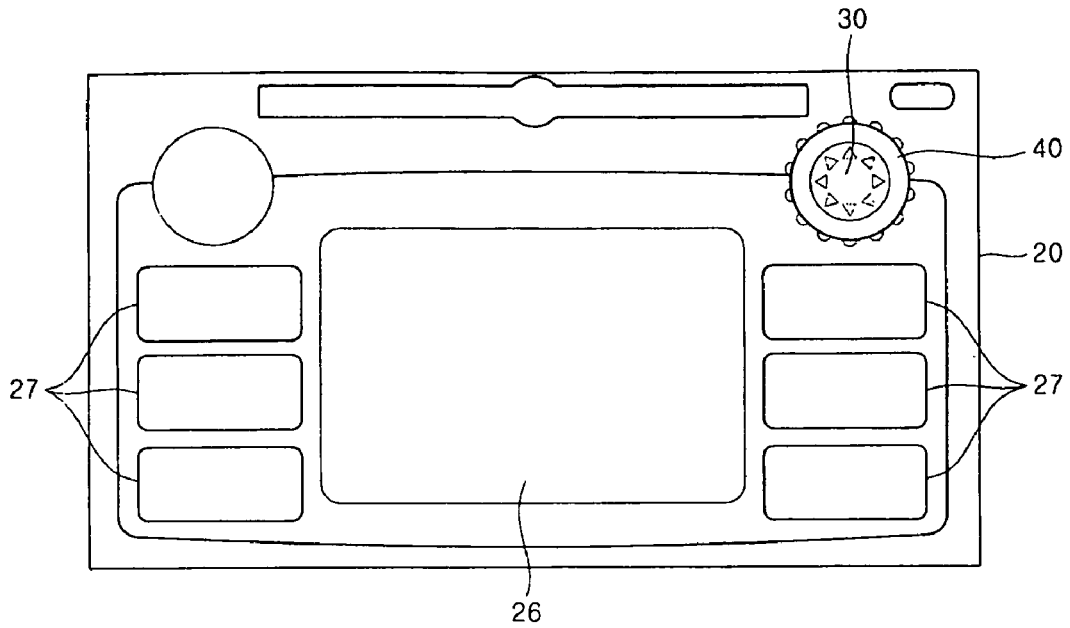
【Fig. 7a】
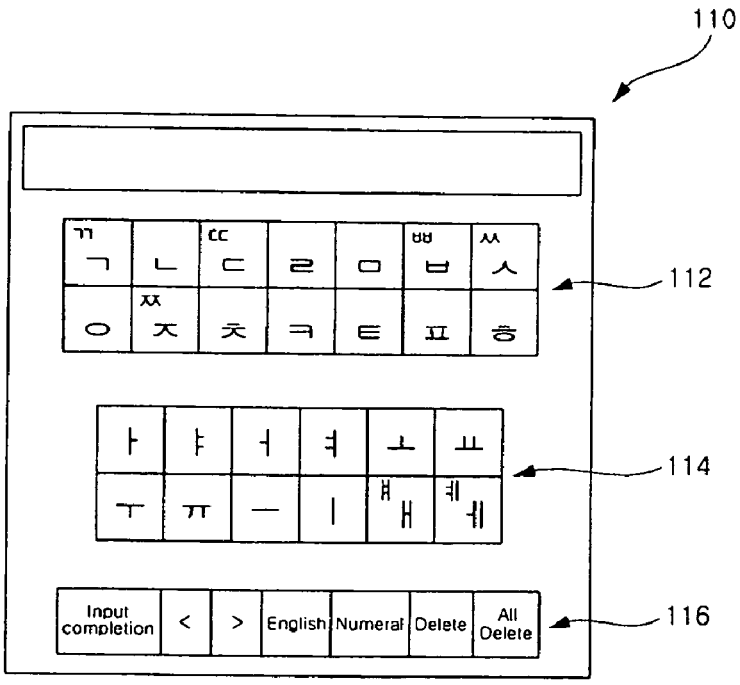

【Fig. 7b】
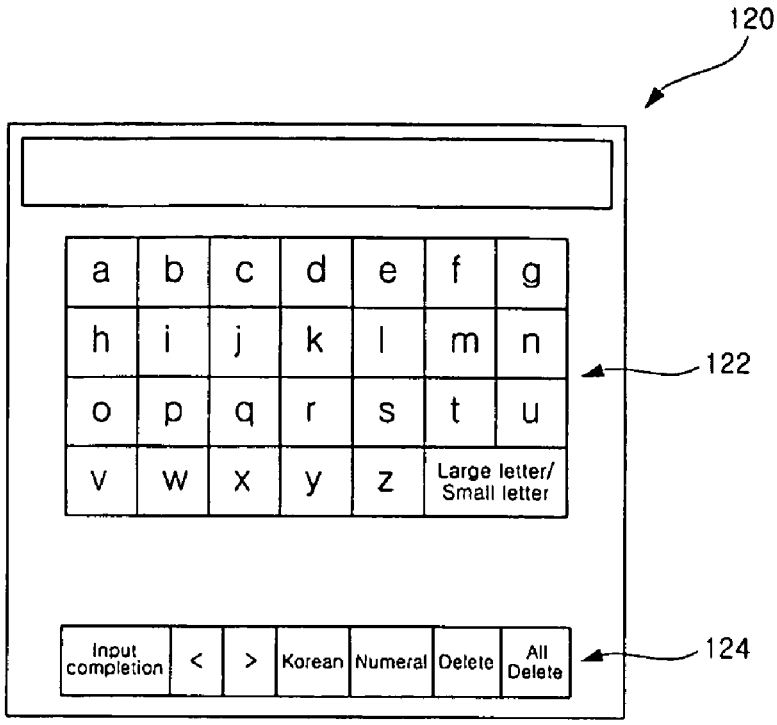
【Fig. 7c】
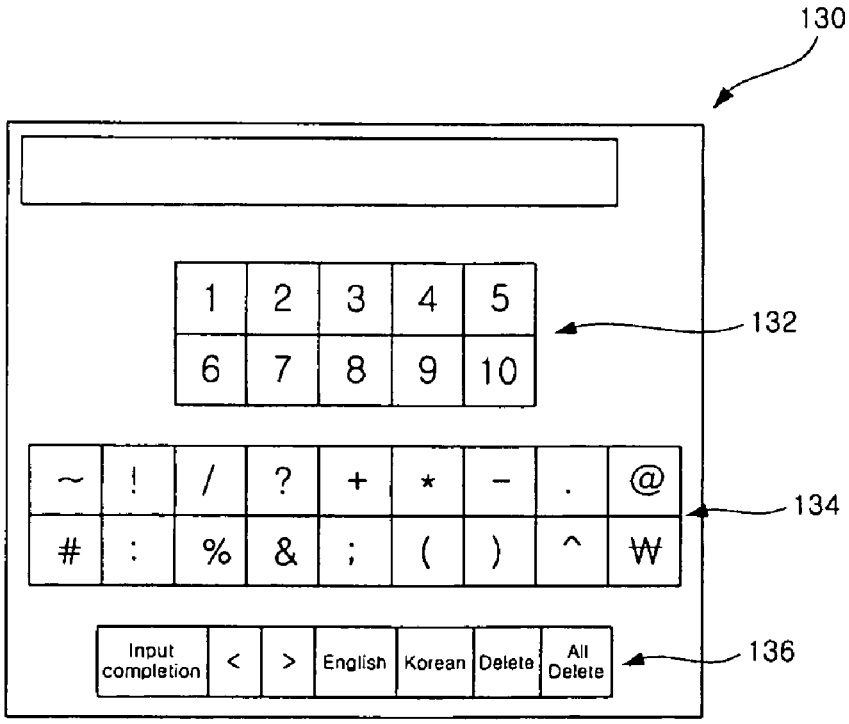

【Fig. 8a】
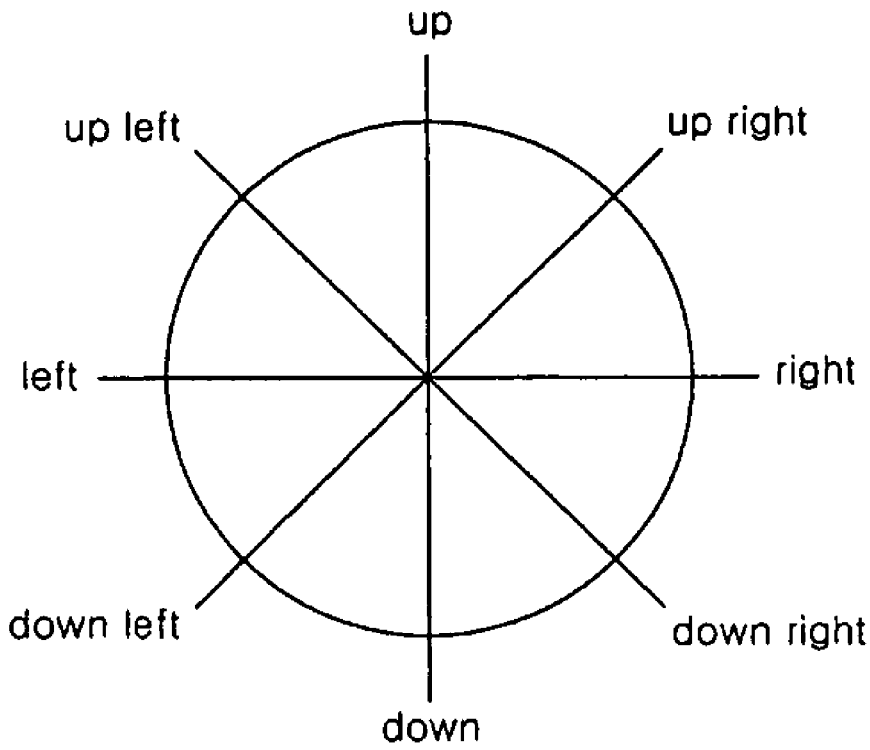
【Fig. 8b】
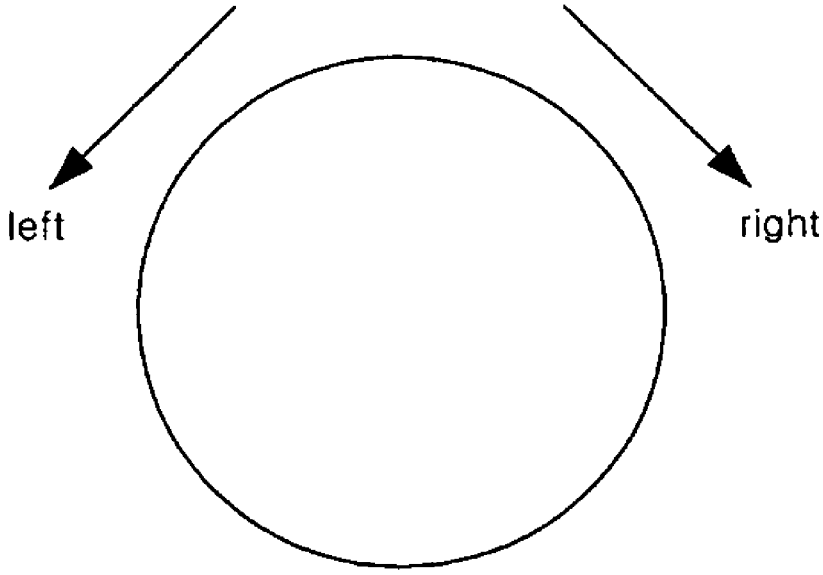

INFORMATION INPUT SYSTEM FOR TERMINAL AND MULTIFUNCTIONAL BUTTON ASSEMBLY FOR USE IN THE SAME

This application is a Divisional of prior application Ser. No. 11/239,361, filed Sep. 30, 2005 now U.S. Pat. No. 7,183,513, which claims priority to Korean Patent Application Nos. 2004-0088290, filed Nov. 2, 2004 and 2005-0048582, filed Jun. 7, 2005. The entire disclosures of the prior applications are considered as being part of the disclosure of this application and are hereby incorporated by reference herein.

BACKGROUND OF THE INVENTION

1. Field of the Invention

The present invention relates to a terminal, and more particularly, to an information input system for allowing a user to input desired information into a terminal and a multifunctional button assembly used in the information input system.

2. Background of the Related Art

Recently, vehicle terminals as well as portable terminals have been widely used. For example, there are portable terminals such as PDAs, MP3 players and mobile phones and vehicle terminals such as telematics terminals.

The telematics terminals will now be described as a representative example. The terminal is generally configured to include a screen with a touch screen function such that a user can input information by touching the screen with a stylus pen or his/her finger. However, an additional input device is required to select a specific function of a terminal or input desired information into the terminal.

Since it is a general trend that the terminal becomes light, thin, short and the compact, the size of a screen therein is also decreased. Therefore, it is very troublesome to press a keypad disposed on the relatively small screen with the stylus pen or user's finger to input the information into the terminal. A related art terminal so configured is shown in FIG. 1.

As shown in FIG. 1, a front plate 1 defines a front appearance of a terminal. The front plate 1 includes a display unit 3. As shown in FIG. 1, a keypad is displayed on the display unit 3 such that a user can input characters into the terminal by pressing the displayed keypad with the stylus pen or his/her finger.

Further, a plurality of function keys 5 are arranged at positions adjacent to both lateral ends of the display unit 3 on the front plate 1. Each of the function keys 5 has a unique function that in turn can be selected and performed when the user presses the function key.

A jog button assembly 7 and a rotary button assembly 9 are also provided on the front plate 1. The jog button assembly 7 can select different functions according to a direction in which it is pressed. As shown in FIG. 1, four different functions can be selected according to four directions in which the jog button assembly can be pressed. The rotary button assembly 9 can be used to adjust, for example, the sound volume by its rotation.

As described above, the prior art terminal has various disadvantages. For example, in a case where a relatively small display unit 3 is used, it is difficult for a user to accurately press characters indicated on the display unit 3. Thus, the user may experience incorrect entries, delay and inconvenience. Further, since the jog button assembly and the rotary button assembly are separately installed on the front plate, the user must separately manipulate the respective button assemblies. In addition, where the jog button assembly and rotary button assembly are separately installed on the front plate, the size of the front plate is increased. Therefore, it is difficult to manufacture a light, thin, small and compact terminal.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the invention is to provide a multifunctional button assembly and methods thereof that can address at least the above problems and/or disadvantages and to provide at least the advantages described hereinafter.

Another object of the invention is to provide a multifunctional button assembly and methods thereof that can be used in an information input system for a terminal and perform a variety of functions.

Another object of the invention is to reduce or minimize a space that is needed to install the multifunctional button assembly used in the information input system for the terminal.

A further object of the invention is to provide an information input system and methods thereof capable of inputting information even when used in a light, thin, short and compact terminal.

According to an aspect of the invention for achieving at least the above objects in whole or in part, there is provided a multifunctional button assembly for a terminal that includes a switch configured with a jog lever and a rotating ring, a lever control button coupled to the jog lever of the switch, wherein the lever control button is configured to control movement of the jog lever in a plurality of angular directions and a vertical direction, and a rotary button coupled to the rotating ring of the switch, wherein the rotary button is configured to control a degree of rotation of the rotating ring, wherein the lever control button is installed within a button through-hole of the rotary button.

According to another aspect of the invention for achieving at least the above objects in whole or in part, there is provided an information input system for a terminal that includes a display unit configured to display a keypad screen and a multifunctional button assembly including a switch configured with a jog lever and a rotating ring, a lever control button coupled to the jog lever of the switch, wherein the lever control button is configured to control movement of the jog lever in a plurality of angular directions and a vertical direction, and a rotary button coupled to the rotating ring of the switch, wherein the rotary button is configured to control a degree of rotation of the rotating ring, wherein the lever control button is installed within a through-hole of the rotary button, wherein the keypad screen is composed of a plurality of blocks each including a plurality of keys, and wherein the blocks and keys are selectable by movement of the lever control button and rotary button.

According to another aspect of the present invention for achieving at least the above objects in a whole or in part, there is provided a method for inputting information into a terminal that includes displaying a keypad screen on a display unit, selecting a block among a plurality of blocks that each include a plurality of keys displayed on the keypad screen, using a single multifunctional selection button, selecting a key among the keys in the selected block using the single multifunctional selection button, and inputting the selected key using the single multifunctional selection button.

According to a multifunctional button assembly of the present invention so configured, since the number of functions of the multifunctional button assembly is relatively greater, a variety of functions can be provided. Thus, a terminal in which the multifunctional button assembly is used can be relatively light, thin, short and compact.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 1 is a diagram of a front view showing the front configuration of a terminal according to the related art;

FIG. 2 is a diagram showing an exploded perspective view of a structure of a multifunctional button assembly for a terminal according to an embodiment of the invention;

FIG. 3 is a diagram showing a side view of a structure of a rotary button of the button assembly according to an embodiment of the invention;

FIG. 4 is a diagram showing a perspective view of a state where both the rotary button and a lever control button are coupled to a switch according to an the invention;

FIG. 5*a* is a diagram showing a perspective view of a state where the lever control button is coupled to the switch according to an embodiment of the invention;

FIG. 5*b* is a diagram showing a perspective view of a state where the rotary button coupled to the switch according to an embodiment of the invention;

FIG. 6 is a diagram showing a front view of an exemplary front plate for an embodiment of an information input system for a terminal according to the invention;

FIGS. 7*a* to 7*c* are diagrams showing exemplary keypad screens displayed on a display unit shown in FIG. 6; and FIGS. 8*a* and 8*b* are diagrams showing exemplary operations of the lever control button and rotary button.

DETAILED DESCRIPTION OF PREFERRED EMBODIMENTS

Embodiments of an information input system for a terminal, a terminal and a multifunctional button assembly for use in the information input system and methods thereof according to the invention will be described with reference to the accompanying drawings.

FIG. 2 is an exploded perspective view showing an embodiment of a multifunctional button assembly according to the invention. FIG. 3 is a rear perspective view showing a structure of a rotary button according to the embodiment, FIG. 4 is a perspective view showing a state where both the rotary button and a lever control button are coupled to a switch according to the embodiment, FIG. 5*a* is a perspective view showing a state where the lever control button is coupled to the switch, and FIG. 5*b* is a perspective view showing a state where the rotary button is coupled to the switch according to the embodiment. As shown in FIGS. 2-5*b*, the embodiment of a multifunctional button can be used in a terminal or in information input system therefore.

As shown in these figures, a front plate 20 can define a front appearance of a terminal. In one embodiment, for example, the front plate 20 of a telematics terminal can be shown. A through-hole 22 (e.g., circular) can be through the front plate 20 with a guide ring 24 fitted around an edge of the through-hole 22.

A display unit 26 can also be provided on the front plate 20. A variety of information can be displayed on the display unit 26. Further, a variety of function keys 27 can be provided in the front plate 20. The function keys 27 can be installed on a front surface of the front plate 20 corresponding to both lateral ends of the display unit 26. However, the invention is not intended to be so limited.

A lever control button 30 can be installed to protrude from a front surface of the front plate 20 through the through-hole 22. The lever control button 30 can have a button head portion 31 (e.g., circular) at a front end thereof. The button head portion 31 can be formed with a concave pushing recess 31'. A user's finger can be placed in the pushing recess 31' such that a user can manipulate the lever control button 30.

A connecting portion 33 can extend rearward from (e.g., the center) a rear surface of the button head portion 31. The connecting portion 33 is a portion that can be placed into a button through-hole 41 of a rotary button 40. The connecting portion 33 can have a diameter relatively smaller than that of the button head portion 31.

A coupling portion 35 can be at a rear end of the connecting portion 33. The coupling portion 35 is a portion that can be coupled to a jog lever 52. The coupling portion 35 can have a diameter relatively larger than that of the connecting portion 33. One reason for the relative sizes is that the connecting portion 33 has a function of connecting the coupling portion 35 and the button head portion 31 whereas the coupling portion 35 can be formed with an insertion hole (not shown) into which the jog lever 52 is inserted.

The rotary button 40 can be to protrude from the front surface of the front plate 20 through the through-hole 22. The rotary button 40 can generally take the shape of a cylinder and include the button through-hole 41 bored through the center thereof. The button through-hole 41 is a portion where the connecting and coupling portions 33 and 35 of the lever control button 30 can be placed. It is preferred that the diameter of the button through-hole 41 be greater than those of the connecting and coupling portions 33 and 35, but less than that of the button head portion 31.

Friction ribs 43 can be around an outer circumferential surface of the rotary button 40. A plurality of the friction ribs 43 can be formed at regular intervals to extend in a direction from a front end to a rear end of the rotary button 40. The friction ribs 43 can reduce or prevent a user's finger from slipping from the outer circumferential surface of the rotary button 40 when the user operates the rotary button 40.

Catching hooks 45 can be provided at a rear end of the rotary button 40 (e.g., to be symmetric with each other). As shown in FIG. 3, the catching hooks 45 can be formed at positions corresponding to an edge of the button through-hole 41. The catching hooks 45 extend to the rear of the rotary button 40 by a predetermined length. A catching step 46 can be formed at a distal end of the catching hook 45. The catching step 46 can protrude from the distal end of the catching hook 45 toward the center of the button through-hole 41.

Guide skirts 47 can be at the rear end of the rotary button 40. The guide skirts 47 can be formed at certain intervals along a circular region where the catching hooks 45 are formed, e.g., positions corresponding to the edge of the button through-hole 41, preferably to be symmetric with each other. As shown in FIG. 3, an angular distance between the central portions of the catching hook 45 and the guide skirt 47 is 90 degrees.

Catching projections 48 can be on the guide skirts 47, respectively. The catching projections 48 can be symmetric with each other with respect to the centerline of the button through-hole 41. Each of the catching projections 48 can protrude further from a central portion of the distal end of the guide skirt 47 and slightly from an inner surface of the guide skirt 47. As shown in FIG. 3, the catching projection 48 can extend from a base portion of the guide skirt 47. Since the catching projection 48 is formed on the guide skirt as described above, the strength of the catching projection 48 can be ensured.

A switch 50 can be mounted, for example, on a substrate 50'. The substrate 50' can be installed on a rear surface of the front plate 20. Further, the substrate 50' can be parallel with the rear surface of the front plate 20. Although in FIG. 2 only the switch 50 is mounted on the substrate 50, the invention is not intended to be so limited. For example the substrate 50' can mount relevant parts associated with display unit 26, the function keys 27 or the like.

A variety of parts of the switch 50 can be installed within a main body 51 of the switch 50. The switch main body 51 can be mounted on the substrate 50' and electrically connected with other parts via the circuit pattern of the substrate 50'.

The switch main body 51 can be provided with a jog lever 52 mechanically connected with the lever control button 30. The jog lever 52 can protrude from (e.g., the center) an upper surface of the switch main body 51. The jog lever 52 is operated in such a manner that it can be inclined in all directions on the upper surface of the switch main body 51. That is, the jog lever can have its free end be freely inclined about its fixed end that is connected to the switch main body 51, whereby a specific function can be selected according to its inclined direction. The jog lever 52 can be supported (e.g., by means of an elastic member) within the switch main body 51 such that it can be restored to an upright position on the upper surface of the switch main body 51. Of course, the above exemplary structure of the jog lever is not necessarily required and the invention is not intended to be so limited.

As described above, the jog lever 52 can be moved (e.g., inclined) in four or eight directions such that a specific function can be selected. Furthermore, the jog lever can be pressed down into the switch main body 51 such that another specific function can be selected.

In the meantime, a rotating ring 53 that surrounds the jog lever 52 can protrude from the upper surface of the switch main body 51. The rotating ring 53 takes a shape (e.g., a ring) and can rotate with respect to the switch main body 51. It is preferred that the jog lever 52 be placed at a position corresponding to the center of the rotating ring 53. Hook slots 54 can be in a surface of the rotating ring 53. Each of the hook slots 54 on an outer surface of the rotating ring 53 can extend in an angular direction of the rotating ring 53. The hook slots 54 can be symmetric with each other around the rotating ring 53. The catching step 46 of the catching hook 45 can be caught into the hook slot 54 such that the rotary button 40 is operated together with the rotating ring 53.

Assembly guide slots 55 in which the catching projections 48 of the rotary button 40 are placed can be in the rotating ring 53 formed symmetric with each other. Each of the assembly guide slots 55 can extend in a direction in which the rotary button 40 is fitted around the rotating ring 53. The guide slot 55 can be slotted up to an upper end of the rotating ring 53 and formed at a position corresponding to the catching projection 48. However, the invention is not intended to be so limited.

Operations of a multifunctional button assembly for a terminal according to the embodiment of FIG. 2 will now be described. As shown in FIG. 2, the rotary button 40 can be placed in the through-hole 22 of the front plate 20 such that at least the friction ribs 43 are exposed to the outside from the through-hole 22.

Preferably, the connecting and coupling portions 33 and 35 of the lever control button 30 are placed in the button through-hole 41 of the rotary button 40. The button head portion 31 of the lever control button 30 can be at a front end of the rotary button 40 corresponding to an opening of the button through-hole 41 of the rotary button 40.

Since the coupling portion 35 of the lever control button 30 is connected to the jog lever 52, the lever control button 30 can move (e.g., incline) in all directions within the button through-hole 41 of the rotary button 40 together with the jog lever 52 for example, to select a specific function. That is, the specific function can be selected according to the inclined direction of the lever control button 30.

Further, the lever control button 30 can be pressed down in a longitudinal direction such that another specific function can be selected. To this end, the user can merely press down the center of the pushing recess 31' of the button head portion 31. For example, the user can move a selection region to a specific position on the display unit 26 by inclining the lever control button 30 toward a specific direction, and then select a function corresponding to the selection region by pressing down the lever control button 30. However, the invention is not intended to be so limited.

The user can manipulate the rotary button 40 (e.g., concurrently) by gripping the outer circumferential surface of the rotary button and rotating the rotary button. The user can select a specific function or adjust the sound volume (e.g., a range of values) of the terminal according to a degree of rotation of the rotary button 40.

The rotary button 40 can be coupled to the rotating ring 53 by causing the catching projections 48 to be placed into the assembly guide slots 55 formed in the rotating ring 53 and also the catching steps 46 of the catching hooks 45 to be caught into the hook slots 54. To prevent the rotary button 40 from being idle when the rotating ring 53 is coupled to the rotary button 40, it is preferred that the width of the assembly guide slot 55 be the same as that of the catching projection 48.

If the user wishes to rotate the rotary button 40, the user can grip the outer circumferential surface of the rotary button 40 and then apply a certain force thereto. At this time, the friction ribs 43 serve to reduce slipping of the user's finger from the outer circumferential surface of the rotary button 40.

As shown in FIGS. 6 and 7*a*-7*c*, an embodiment of an information input system according to the invention will now be described. The embodiment of the information input system will be described using the multifunctional button assembly of FIG. 2. However, the invention is not intended to be so limited.

As shown in FIG. 6, the display unit 26 on which information is displayed can be provided on the front plate 20 of the terminal. The display unit 26 is, for example, a 3.8-inch LCD. The plurality of function keys 27 can be on regions of the front plate 20 corresponding to both lateral ends of the display unit 26, and the lever control button 30 and rotary button 40 constituting the multifunctional button-assembly can protrude from a region above a set of the function keys 27 located at one lateral end of the display unit 26.

The multifunctional button assembly preferably includes the lever control button 30, which can be inclined to specific directions to select specific functions, and the rotary button 40, which can be rotated to select the other functions, such that a desired function can be selected. Of course, the multifunctional button assembly need not necessarily be installed on the front plate 20 or at any specific position on the front plate 20.

FIGS. 7*a* to 7*c* show exemplary keypad screens that can be displayed on the display unit 26. FIG. 7*a* shows a keypad screen 110 for inputting Korean characters, FIG. 7*b* shows a keypad screen 20 for inputting English characters, and FIG. 7*c* shows a keypad screen 130 for inputting numerals/symbols. However, the invention is not intended to be so limited.

Each of the keypad screens 110, 120 and 130 can include a plurality of blocks. As shown in FIG. 7*a*, the keypad screen 110 for inputting Korean characters can include a first block 112 on which a plurality of Korean consonant keys are displayed, a second block 114 on which a plurality of Korean vowel keys are displayed, and a third block 116 on the which a plurality of function keys are displayed. Of course, the keys displayed on the blocks 112, 114 and 116 may be classified according to a variety of criteria, in addition to the keys shown in these figures.

The keypad screen 120 for inputting English characters as shown in FIG. 7*b* can include a first block 122 on with a plurality of English alphabet keys are displayed, and a second block 124 on which a plurality of function keys are displayed. The keypad screen 130 for inputting the numerals/symbols as shown in FIG. 7*c* can include a first block 132 on which a plurality of numeral keys are displayed, a second block 134 on which a plurality of symbol keys are displayed, and a third block 136 on which a plurality of function keys are displayed.

Further, FIG. 8*a* shows exemplary operations of the lever control button 30. For example, the user can manipulate the lever control button 30 such that the jog lever 52 can be inclined, for example, to the up, down, right, left, up-left, up-right, down-left and down-right directions. A cursor displayed on the display unit 26 can be moved in the inclined direction of the jog lever 52 as a result of these manipulations.

For example, although it has been described in one illustrated embodiment that the lever control button allows the jog lever to be moved in all direction such that the maximum eight functions can be selected, it is not necessarily limited thereto. Embodiments of the invention may be configured such that a various number of functions can be selected.

FIG. 8*b* shows exemplary operations of rotary button 40. For example, the user can select a desired function by rotating the rotary button 40 counterclockwise or clockwise. For example, a cursor display on the display unit 26 can be moved in the right or left direction corresponding to the rotation of the rotary button 40.

According to one embodiment of the invention, the lever control button 30 can move a cursor displayed on the display unit 26 between the blocks 112, 114, 116, 122, 124, 132, 134 and 136. Further, the rotary button 40 can move the cursor between the keys displayed on the selected block 112, 114, 116, 122, 124, 132, 134 or 136.

Therefore, the user can select a specific block 112, 114, 116, 122, 124, 132, 134 or 136 using the lever control button 30, and then select a specific key within the selected block 112, 114, 116, 122, 124, 132, 134 or 136 using the rotary button 40. However, the invention is not intended to be so limited. For example, the lever control button 30 can be used to move a cursor between rows of keys and the rotary button can be used to move the cursor along one row of the keys.

Operations of inputting necessary information into the terminal using the embodiment of information input system according to the invention will be described. First, the user can clear the previous image displayed on the display unit 26 of the terminal, and cause one of the keypad screens shown in FIGS. 7*a* to 7*c* to be displayed on the display unit 26. To this end, any one of the function keys 27 can be used.

After the keypad screen shown in FIG. 7*a*, 7*b* or 7*c* has been displayed, the user can manipulate the multifunctional button assembly to input a desired word. For example, if the user wishes to input a word 'good', he/she can move a cursor on the first block 122 of the keypad screen 120 using the lever control button 30.

After the cursor is moved on the first block 122, it the cursor can be moved on the character key with a character 'g' indicated thereon by rotating the rotary button 40. Then, the character key with a character 'g' indicated thereon can be selected by pressing down the button head portion 31 of the lever control button 30.

Next, the user can rotate the rotary button 40 to move the cursor onto the character key with a character 'o' indicated thereon, and then press down the button head portion 31 to select the character key with the character 'o' indicated thereon. At this time, since the character 'o' is repeated once again, the user can again press down the button head portion 31 to select the character 'o' once more. Therefore, it is in a state where the selection of characters up to 'goo' has been made.

Further, the user can rotate the rotary button 40 to move the cursor on the character key with a character 'd' indicated thereon. After the cursor has been moved to the character key with the character 'd' indicated thereon, the user can press down the button head portion 31 to select the character 'd'. Therefore, the selection of a word 'good' can be completed.

In addition, if the user wishes to input the selected word, he/she can move a cursor to an 'input completion' key provided in the second block 124 of the keypad screen 120. The user can use the lever control button 30 to move a cursor from the first block 122 to the second block 124.

If the cursor is moved to the second block 124, the user can rotate the rotary button 40 to move the cursor to a desired key displayed on the second block 124. For example, after the cursor has been located at the 'input completion' key, the user presses down the button head portion 31 to perform a function corresponding to the 'input completion' key.

Alternatively, an embodiment of the invention may be configured to automatically select a desired key if a predetermined period of time elapses after the cursor has been moved to the relevant key. Similarly, a word input may be completed.

To change the keypad screen of FIG. 7*b* to the keypad screen of FIG. 7*a*, the user can select a 'Korean' key disposed on the second block 124 of the keypad screen 120. Similarly, the user can select a 'numeral' key displayed on the second block 124 to change the keypad screen of FIG. 7*b* to the keypad screen of FIG. 7*c*.

As described above with respect to embodiments of the invention, telemetric terminals can be a representative example. However, the invention is not intended to be so limited.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

As described above, embodiments of a multifunctional button, and information input system using the same and a terminal and methods thereof have various advantages. For example, since a lever control button capable of operating a jog lever and a rotary button capable of selecting a specific function are simultaneously provided in a single multifunctional button assembly, more various functions can be selected with only the single button assembly. Further, since a lever control button and a rotary button are provided in a single button assembly, there is also an advantage in that a terminal in which embodiments of the multifunctional button assembly of the invention is employed can be manufactured to be light, thin, short and compact. In an embodiment of information input system of the invention, a keypad screen used for inputting characters, numerals and symbols can include a plurality of blocks each including a plurality of keys such that the multifunctional button (lever control button) can be used for the movement between the blocks and (rotary button) selection of a desired key in the selected block. Accordingly, necessary information can be input more rapidly, correctly and easily, even though a relatively smaller display unit is utilized.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An information input system for a terminal, comprising:

a display unit configured to display a keypad screen; and a multifunctional button assembly comprising, a switch configured with a jog lever and a rotating ring, a lever control button coupled to the jog lever of the switch, wherein the lever control button is configured to control movement of the jog lever in a plurality of angular directions and a vertical direction, and a rotary button coupled to the rotating ring of the switch, wherein the rotary button is configured to control a degree of rotation of the rotating ring, wherein the lever control button is installed within a through-hole of the rotary button, wherein the keypad screen is composed of a plurality of blocks each including a plurality of keys, and wherein the blocks and keys are selectable by movement of the lever control button and rotary button.

2. The information input system of claim 1, wherein the lever control button moves a cursor of the display unit between the blocks displayed on the keypad screen, and wherein the rotary button moves a cursor of the display unit between the keys in the selected block displayed on the keypad screen.

3. The information input system of claim 1, wherein the rotary button moves a cursor of the display unit along rows of the keys in the selected block displayed on the keypad screen, and wherein the lever control button moves the cursor of the display unit between rows of the keys in the selected block.

4. The information input system of claim 1, wherein the keypad screen includes at least one keypad screen for inputting characters of a corresponding country and at least one keypad screen for inputting numerals/symbols.

5. The information input system of claim 4, wherein the keypad screen for inputting the characters includes a first block on which consonant keys are displayed, a second block on which vowel keys are displayed, and a third block on which function keys are displayed.

6. The information input system of claim 4, wherein the keypad screen for inputting the characters is composed of a first block on which alphabet keys are displayed, and a second block on which function keys are displayed.

7. The information input system of claim 4, wherein the keypad screen for inputting numerals/symbols is composed of a first block on which numeral keys are displayed, a second block on which symbol keys are displayed, and a third block on which function keys are displayed, and wherein a content of a key on which a cursor is positioned is input into the terminal when the center of the lever control button is pressed down.

8. The information input system of claim 1, wherein the rotating ring has a plurality of recessed hook slots and a plurality of catching steps extend from the rotary button, wherein the catching hooks in the rotary button are configured to insert and be caught in the hook slots, wherein at least one assembly guide slots in the rotating ring is recessed in an insertion direction of the rotary button into the rotating ring, and wherein catching projections extending from a rear of the rotary button are received in the assembly guide slots.

9. The information input system of claim 1, comprising:

a front plate configured to have the display unit and the multifunctional button assembly exposed therein, wherein the lever control button comprises, a button head portion positioned at an outer opening of the button through-hole of the rotary button, a connecting portion positioned in the button through-hole of the rotating button, wherein the connecting portion has an outer diameter smaller than an inner diameter of the button through-hole and extends from the rear of the button head portion by a predetermined length, and a coupling portion positioned in the button through-hole of the rotating button with an outer diameter smaller than the inner diameter of the button through-hole and larger than the outer diameter of the connecting portion, wherein the coupling portion extends from a rear end of the connecting portion to engage the jog lever of the switch.

10. A method for inputting information into a terminal, comprising:

displaying a keypad screen on a display unit;

selecting a block among a plurality of blocks that each include a plurality of keys displayed on the keypad screen, using a single multifunctional selection button;

selecting a key among the keys in the selected block using the single multifunctional selection button; and inputting the selected key using the single multifunctional selection button.

11. The method of claim 10, wherein the block selection is made by a lever control button of a multifunctional selection button, the key selection is made by a rotary button of the multifunctional selection button, and the selected key input is made by pressing down the lever control button.

* * * * *